US005977879A

United States Patent [19]

Shougomori

[11] Patent Number: 5,977,879

[45] Date of Patent: Nov. 2, 1999

[54] DISPLAY DEVICE AND AN INSPECTION CIRCUIT

[75] Inventor: Masanari Shougomori, Kyoto, Japan

[73] Assignee: Rohm Co. Ltd., Kyoto, Japan

[21] Appl. No.: 09/026,546

[22] Filed: Feb. 20, 1998

[30] Foreign Application Priority Data

Feb. 21, 1997 [JP] Japan ..... 9-037810

[51] Int. Cl.[6] ..... G08B 5/02

[52] U.S. Cl. ..... 340/815.52; 340/458; 340/641; 340/642; 340/815.44; 340/815.47; 340/815.53; 359/59; 359/72

[58] Field of Search ..... 340/815.52, 815.47, 340/815.44, 636, 641, 458, 642, 815.53; 347/122; 250/369; 359/59, 72

[56] References Cited

U.S. PATENT DOCUMENTS

| | | | |
|---|---|---|---|
| 3,792,276 | 2/1974 | Toman et al. | 250/369 |
| 4,143,297 | 3/1979 | Fischer | 313/502 |
| 5,056,897 | 10/1991 | Akiyama et al. | 359/72 |
| 5,377,031 | 12/1994 | Vu et al. | 359/59 |
| 5,402,157 | 3/1995 | Nagato et al. | 347/122 |

*Primary Examiner*—Edward Lefkowitz
*Assistant Examiner*—Davetta Woods
*Attorney, Agent, or Firm*—Nikaido Marmelstein Murray & Oram LLP

[57] ABSTRACT

A display device having driving circuits one for each of its light-emitting elements permits easy inspection of the driving circuits. The display device is formed as a fluorescent display tube that has an array of light-emitting units each consisting of a light-emitting element and its driving circuit. The display device further has a multiple-stage AND circuit consisting of 2-input AND circuits connected sequentially. One input of each stage is connected to the output of one of the driving circuits, another input of the first stage is connected to a power line, and the output of the last stage is connected to an inspection terminal, so that inspection is performed by checking whether a driving voltage appears at the inspection terminal. By activating all the driving circuits, whether they are functioning properly when they are in operation is checked globally; then, by deactivating one of the driving circuits, whether they are functioning properly when they are not in operation is checked individually. Instead of the multiple-stage AND circuit, a multiple-stage OR circuit may be used, in which case the other input of the first stage is grounded, and the output of the last stage is connected to the inspection terminal.

8 Claims, 6 Drawing Sheets

DISPLAY DEVICE AND AN INSPECTION CIRCUIT

BACKGROUND OF THE INVENTION

1. Field of the Invention

The present invention relates to a display device that drives a plurality of light-emitting elements individually through driving circuits provided one for each light-emitting element, and to an inspection circuit suitable for the inspection of such driving circuits.

2. Description of the Prior Art

Display devices are known that are provided with a plurality of light-emitting elements arranged in a predetermined pattern or in a regular matrix (array) and that for desired displayed images by controlling the turning on and off of the light-emitting elements individually.

A typical example of a display device hating light-emitting elements arranged in a predetermined pattern is a 7-segment light-emitting diode (LED) display device that displays numerals and alphabets with seven picture elements. With such a display device, which has a relatively small number picture elements, it is customary to control the turning on and off of the light-emitting elements individually through driving circuits provided one for each light-emitting element.

Another example is a fluorescent display tube, which is a display device that has not only light-emitting elements arranged in a matrix but also fluorescent spots serving as picture elements arranged in rows and columns and that makes them emit light by the action of thermoelectrons. Conventionally, in a fluorescent display tube, picture elements that are to be turned on are selected through time-division driving achieved by the use of strip-shaped electrodes. In recent years, however, to avoid inconveniences inherent in time-division driving, it is common to provide driving circuits one for each picture element to control the turning on and off of the light-emitting elements individually.

By providing driving circuits one for each picture element, it is possible to reduce the driving voltage, which leads to many advantages such as reduction in the power consumption, reduction in the heat generated, simplification of the driving circuits, and an extended working life of the fluorescent spots. On the other hand, however, exactly because this construction requires as many driving circuits as picture elements, it inevitably requires too many driving circuits to display high-resolution images.

A fluorescent display tube that has driving circuits one for each picture element is constructed as follows. On a semiconductor chip, driving circuits and electrodes are formed in a matrix, and, over the surfaces of these electrodes, fluorescent material is applied. A hot cathode is placed opposite this semiconductor chip, with a grid between them, and all of these components are housed in a tube, which is then evacuated of air. The electrodes are formed on the surfaces of the semiconductor layers at the top of the driving circuits, and the voltages at the electrodes are varied by the driving circuits. Such changes in the voltages at the electrodes cause changes in the number of thermoelectrons striking the fluorescent spots, and thereby the emission of light is controlled.

Usually, driving circuits formed on a semiconductor chip are inspected by touching the output pad of each driving circuit with a probe to measure the voltage there. However, in the fluorescent display tube described above, it is extremely difficult to use this inspection method, because the driving circuits are connected directly to the electrodes without using pads or the like, that is, the electrodes are formed immediately on the top of the driving circuits, and therefore touching the electrodes with a probe results in damaging the driving circuits.

For this reason, in a fluorescent display tube of this type, the driving circuits are inspected by checking actual emission of light, that is, by feeding driving voltages to the electrodes to actually drive the driving circuits and checking whether each fluorescent spot emits light or not through observation with the unaided eye or through measurement with an optical instrument.

However, in a fluorescent display tube, emission of light is possible only after the application of fluorescent material to the electrodes, the arrangement of the hot cathode, and the evacuation of air from the tube. In other words, the fluorescent display tube can emit light only after it has been finished as an end product. This means that it is practically impossible to inspect the driving circuits in the middle of manufacture. As a result, it is inevitable to finish a product first of all by going through all manufacturing steps even if there are defects in the driving circuits, and thus it is impossible to improve productivity.

In addition, it is not easy to check emission of light with the unaided eye. In a display tube with a relatively small number of picture elements over a relatively wide area, it is possible to observe emission of light from all picture elements at a time. However, in a display tube with many picture elements arranged close to one another, when all picture elements are turned on at a time, some defective picture elements may go unnoticed even if they do not emit light. Accordingly, it is necessary to make the picture elements emit light individually, and thus inspection requires much labor and time. Using an optical instrument for light detection improves inspection efficiency, but, in a fluorescent display tube with many picture elements arranged close to one another, it is all the same necessary to make the picture elements emit light individually, and thus inspection requires much time.

On the other hand, with the 7-segment LED display device mentioned earlier, where the driving circuits are provided with output pads, it is possible to adopt the inspection method that uses a probe. Accordingly, it is possible to inspect the driving circuits without actually effecting light emission. However, it is necessary to measure the voltage at the output of each driving circuit by touching one output pad after another with the probe, and therefore inspection requires more time as there are more picture elements.

As described above, in a conventional display device that has driving circuits one for each light-emitting element, inspection of the driving circuits is not easy, and, depending on the light emission method that the display device adopts, inspection of the driving circuit is simply impossible until the completion of manufacture. In addition, in a display device that has a large number of light-emitting elements, inspection requires too much time.

SUMMARY OF THE INVENTION

An object of the present invention is to provide a display device that permits inspection of its driving circuits even in the middle of manufacture regardless of the light emission method adopted and that allows all driving circuits to be inspected in a considerably short time regardless of the number of light-emitting elements contained. Another object of the present invention is to provide an inspection circuit suitable for such inspection.

To achieve the above objects, according to one aspect of the present invention, in a display device having a plurality of light-emitting units each comprising a light-emitting element and a driving circuit, each light-emitting unit includes a logic circuit that has a first input terminal, a second input terminal, and an output terminal and that performs a logic operation on an input received at the first input terminal and an input received at the second input terminal to output a result of the operation to the output terminal. Moreover, in each light-emitting unit, an output terminal of the driving circuit is connected to the first input terminal of the logic circuit. Furthermore, the output terminal of the logic circuit of one light-emitting unit is connected to the second input terminal of the logic circuit of a next light-emitting unit, so that the logic circuits throughout the display device form a multiple-stage logic circuit as a whole.

Whether a light-emitting element is turned on or off depends on whether the output from the corresponding driving circuit is present or not. Light emission of each light-emitting unit is controlled separately, and different patterns created by turning on some of the light-emitting units and turning off others result in different displayed images. The logic circuits that form a multiple-stage logic circuit, except the one at the first stage, each perform a logic operation on the output of the driving circuit of the corresponding light-emitting unit and the output of the logic circuit at the previous stage, and output an operation result. Thus, the logic circuit at the last stage yields an output that represents whether the outputs from the individual driving circuits are present or not, and, in this way, it is possible to obtain information as to how the individual driving circuits are functioning. Depending on the type of the logic circuit employed at each stage and the level of the input fed to the second input terminal of the logic circuit at the first stage, different information is obtained as the output of the last stage.

In this display device, when AND circuits are used as the logic circuits, the logic circuit at the last stage represents the logical product of the outputs of all the driving circuits. That is, the output of the last stage is true only when the outputs from all the driving circuits are present, and it is false when the output of any one of the driving circuits is absent.

Alternatively, when OR circuits are used as the logic circuits, the logic circuit at the last stage represents the logical sum of the outputs of all the driving circuits. That is, the output of the last stage is false only when the outputs from all the driving circuits are absent, and it is true when the output of any one of the driving circuits is present.

It is also possible to construct the display device in such a way that the logic circuits throughout the display device are divided into two groups each forming a separate multiple-stage logic circuit as a whole, one group including only AND circuits and having an output terminal of the last-stage AND circuit connected to an input terminal of an exclusive OR circuit, the other group including only OR circuits and having an output terminal of the last-stage OR circuit connected to another input terminal of the exclusive OR circuit. In this case, the output of the exclusive OR circuit is true when the outputs from all the driving circuits are present or absent, and it is false when the outputs from part of the driving circuits are present.

It is also possible to form the display device as a fluorescent display tube by forming each light-emitting element as a spot of fluorescent material and housing the plurality of light-emitting units in a vacuum tube. With the fluorescent display tube, it is not possible to effect light emission before the completion of manufacture; nevertheless, it is possible to check the output of the last-stage logic circuit by putting only the driving circuits in operation, and thus to inspect the driving circuits before they are housed in a vacuum tube.

To achieve the above objects, according to another aspect of the present invention, in an inspection circuit for inspecting a plurality of electric circuits that each output a first voltage when in operation and output a second voltage lower than the first voltage when not in operation, a multiple-stage logic circuit is provided that consists of a plurality of identical two-input logic operation circuits that are connected one to the next and that each output either the first voltage or the second voltage in accordance with a result of operation, the multiple-stage logic circuit receiving, as inputs to its individual stages, outputs of the plurality of electric circuits and receiving, as an input to its first stage, the first or second voltage so that a voltage outputted from its last stage indicates whether the plurality of electric circuits are functioning properly or not.

The first stage of the multiple-stage logic circuit performs a logic operation on the received first or second voltage and the output voltage of one of the electric circuits, and outputs an operation result. Each of the stages following the first stage performs a logic operation on the first or second voltage outputted from the previous stage and the output voltage of the corresponding one of the electric circuits, and outputs an operation result. Thus, the last stage outputs the result of the logic operation performed on the output voltages of all the electric circuits, and, in this way, it is possible to obtain information as to whether the electric circuits are functioning properly or not. That is, the output voltage of the last stage indicates whether the electric circuits are functioning properly or not. Depending on what type of logic operation circuit is employed at each stage and whether the first stage receives the first or second voltage, the output voltage at the last stage indicates, for different ones of the electric circuits in different states, whether they are functioning properly or not, using different levels of voltage to indicate proper and improper functioning.

For example, it is possible to construct this inspection circuit in such a way that the two-input logic operation circuits are AND circuits, and that the first voltage is fed to the input of the first stage so that the voltage that is outputted from the last stage when all electric circuits are in operation indicates globally whether the electric circuits are functioning properly or not as a whole when they are in operation, and the voltage that is outputted from the last stage when only one electric circuit is not in operation indicates individually whether that one electric circuit is functioning properly or not when it is not in operation.

Alternatively, it is also possible to construct the inspection circuit in such a way that the two-input logic operation circuits are OR circuits, and that the second voltage is fed to the input of the first stage so that the voltage that is outputted from the last stage when no electric circuits are in operation indicates globally whether the electric circuits are functioning properly or not as a whole when they are not in operation, and the voltage that is outputted from the last stage when only one electric circuit is in operation indicates individually whether that one electric circuit is functioning properly or not when it is in operation.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
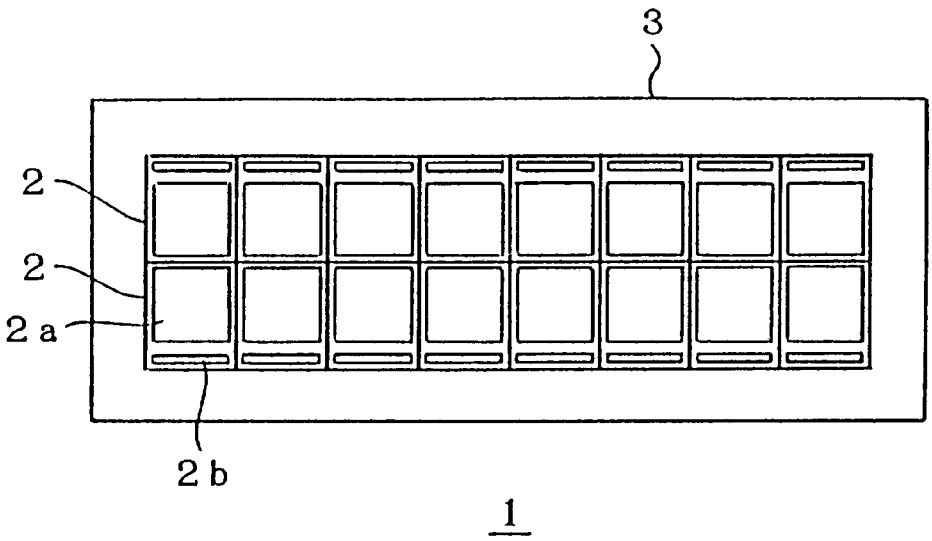
FIG. 1 is a plan view showing the construction of the fluorescent display tube of a first embodiment of the invention.

Hereinafter, embodiments of the present invention will be described with reference to the drawings. FIG. 1 is a plan view schematically showing the construction of the fluorescent display tube of a first embodiment of the invention. The fluorescent display tube 1 has 16 semiconductor chips 2 arranged in two rows and housed in a transparent glass tube 3 that is evacuated of air. Each chip 2 measures 5.4×5.6 mm, and has a square-shaped display section 2*a* and an input/output section 2*b* along one edge.

Figure 3:
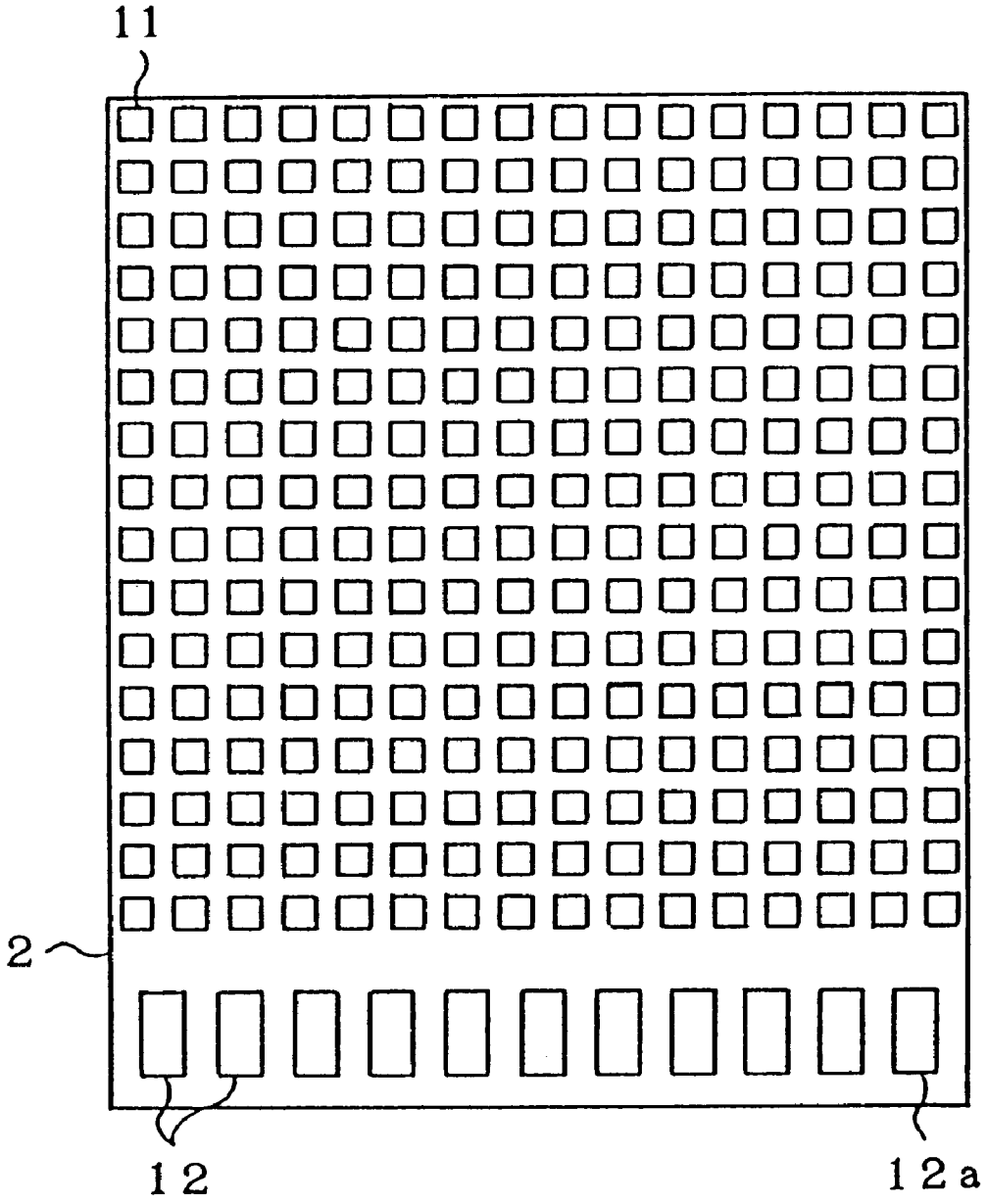
FIG. 3 is a plan view of the semiconductor chip employed in the fluorescent display tube.

FIG. 3 is a plan view of the semiconductor chip 2. Over the surface of the chip 2 are formed 256 picture elements 11 constituting the display section 2*a* and 11 input/output terminals 12 constituting the input/output section 2*b*. Each picture element 11 measures about 0.2×0.2 mm, and the picture elements are arranged at regular intervals in a 16×16-element matrix (array). The distance from the center of an outermost picture element to an edge of the chip is set to about half the interval between the centers of two adjacent picture elements, so that, when two or more chips 2 are arranged side by side as shown in FIG. 1, the picture elements of all chips are arranged at regular intervals and thereby seamless images can be obtained as a whole.

The input/output terminals 12 include, as well as input terminals such as a power feed terminal and a signal feed terminal, a ground terminal and an output terminal 12*a*. As will be described later, the output terminal 12*a* is used as an inspection terminal in the inspection of the driving circuits formed on the chip 2.

Figure 2:
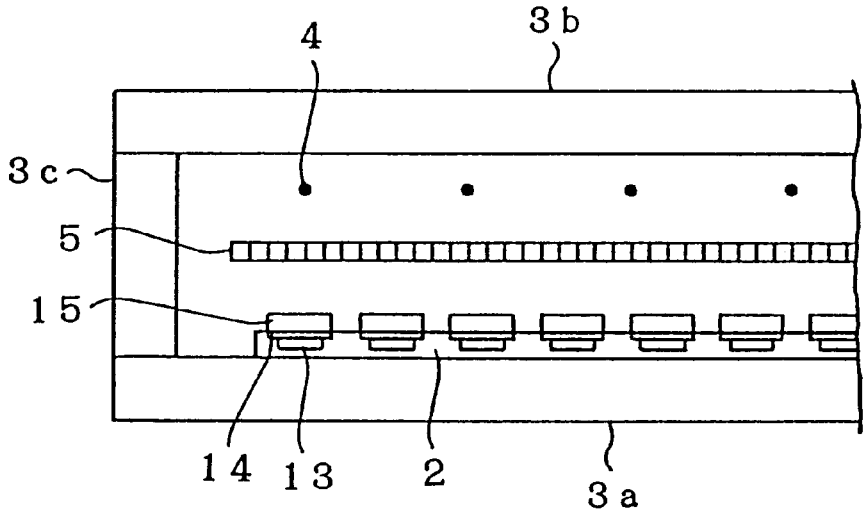
FIG. 2 is a section of a part of the fluorescent display tube.

FIG. 2 shows a section of a part of the fluorescent display tube 1. The semiconductor chip 2 is fixed on a glass substrate 3*a*, and, over them, a plurality of hot cathodes 4 are arranged parallel to one another. Between the chip 2 and the hot cathodes 4, a grid 5 is arranged so as to face the entire display sections 2*a*. The chip 2, the hot cathodes 4, and the grid 5 are enclosed by glass plates 3*b* and 3*c* that together with the glass substrate 3*a* form a glass tube 3 evacuated of air.

Inside the semiconductor chip 2, just below the picture elements 11, 256 driving circuits 13 are formed. On the top of each driving circuit 13, an electrode 14 is formed, to which the output voltage of the driving circuit 13 is applied. The top surface of each electrode 14 is coated with fluorescent material 15. In this way, one driving circuit 13, one electrode 14, and one spot of fluorescent material 15 constitute one light-emitting unit.

The thermoelectrons emitted from the hot cathodes 4 pass through the grid 5 and strike the fluorescent material 15, making it emit light. Whether the thermoelectrons strike a particular fluorescent spot 15 or not depends on the voltage at the corresponding electrode 14. That is, it is possible to control light emission of each fluorescent spot 15, thus each light-emitting unit, thus each picture element, separately by controlling a driving voltage. The fluorescent spot 15 continues emitting light as long as the driving circuit 13 is outputting the driving voltage, and the former stops emitting light when the latter ceases to output the driving voltage.

The semiconductor chip 2 is further provided with a control circuit (not shown). All the driving circuits 13 are connected to this control circuit and to the power feed terminal, and their output operation is controlled by control signals fed from the control circuit. The control circuit is connected to the signal feed terminal, and controls each driving circuit 13 in accordance with signals fed from the outside via the signal feed terminal. As a result, selected ones of the picture elements 11 are turned on to emit light, and thereby an image is displayed.

Figure 4:
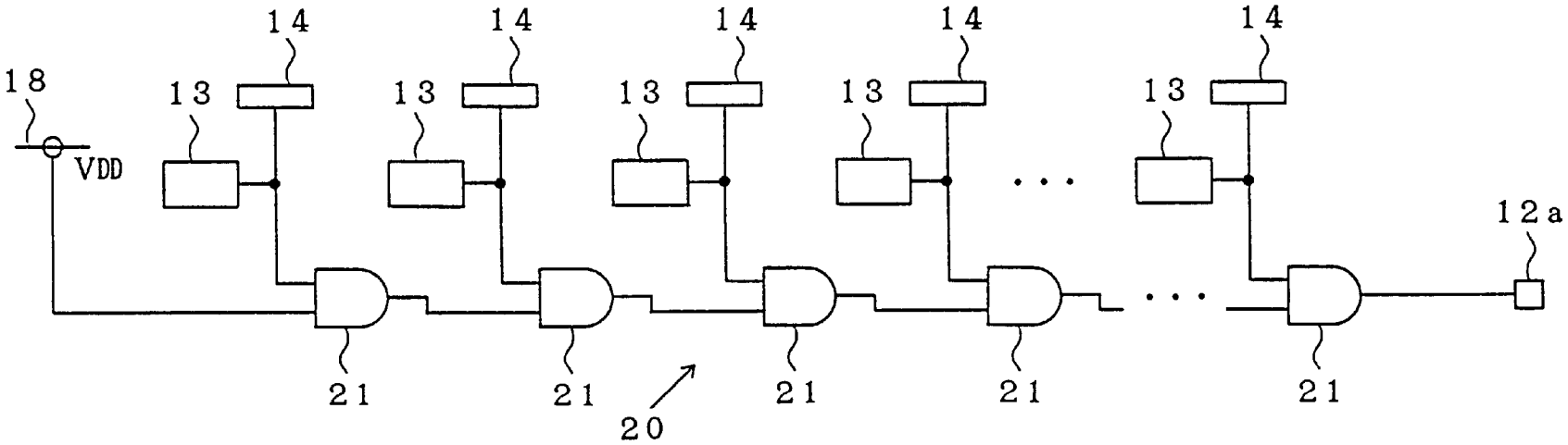
FIG. 4 is a diagram showing an example of the construction of the multiple-stage AND circuit formed on the semiconductor chip shown in FIG. 3.

In the semiconductor chip 2, each light-emitting unit is provided with a two-input AND circuit for the inspection of its own driving circuit 13, and all the AND circuits throughout the chip are connected together, with the output terminal of one AND circuit connected to the input terminal of the next, to form a multiple-stage AND circuit as a whole. FIG. 4 shows the construction of the multiple-stage AND circuit.

In the multiple-stage AND circuit 20, one input terminal of each AND circuit 21 is connected to the output of the corresponding driving circuit 13, and the other input terminal of each AND circuit 21, except the one at the first stage, is connected to the output terminal of the previous stage; the other input terminal of the AND circuit at the first stage is connected to a power source line whose voltage is equal to the driving voltage that each driving circuit 13 outputs. The output of the AND circuit 21 at the last stage is connected to the earlier-mentioned inspection terminal 12*a*.

The AND circuit 21 at each stage performs the AND operation on its two inputs, and outputs to the output terminal a voltage equal to the driving voltage output from the driving circuit 13 when the result of the operation is true and a ground voltage when the result is false. The output of the AND circuit 21 at the last stage is equal to the driving voltage only when all the driving circuits 13 are outputting the driving voltage, and it is equal to the ground voltage when any of the driving circuits fails to output the driving voltage.

The semiconductor chip 2 provided with the above multiple-stage AND circuit 20 permits inspection of the driving circuits 13 any time after their formation. Specifically, the inspection is performed as follows. First, all the driving circuits 13 are fed with a control signal that requests output of the driving voltage, and the voltage at the inspection terminal 12*a* is measured. If the driving voltage is detected there, it is known that all the driving circuits 13 are outputting the driving voltage; if the ground voltage is detected there, it is known that one or more driving circuits are defective circuits that cannot output the driving voltage due to some defect such as an imperfect contact within themselves. Thus, through this inspection, it is possible to check globally whether the driving circuits 13 are functioning properly or not as a whole when they are in operation.

If no defect has been found through the above operation-time inspection process, then one of the driving circuits 13 is fed with a control signal that inhibits output of the driving voltage, with all the other driving circuits 13 fed with a control signal that requests output of the driving signal, and the voltage at the inspection terminal 12*a* is measured. If the ground voltage is detected there, it is known that the inhibited driving circuit has properly inhibited output of the driving signal; if the driving voltage is detected there, it is known that the inhibited driving circuit is a defective circuit that outputs the driving voltage all the time due to some defect such as a short circuit within itself. By applying the control signal that inhibits output of the driving signal to one driving circuit after another, it is possible to check individually whether each driving circuit 13 is functioning properly or not when it is not in operation.

After these inspection processes, semiconductor chips 2 that have been found to be functioning properly both when they are in operation and when they are not are arranged as shown in FIG. 1, and then hot cathodes 4 and a grid 5 are arranged, and thus a fluorescent display tube 1 is obtained. The fluorescent display tube 1 as an end product is then subjected to final inspection in which light emission is actually effected, but, at this time, it is not necessary to conduct any inspection with respect to the driving circuits 13.

The multiple-stage AND circuit 20 may be provided outside the display sections 2*a*; however, it is preferable to form it by incorporating a logic circuit 21 into each driving circuit 13 and wring all those logic circuits together. In the former construction, it is necessary to form the multiple-stage AND circuit separately from the driving circuits, which requires complicate manufacturing processes, and, in addition, it is necessary to secure extra space to form the multiple-stage AND circuit within the semiconductor chip 2, which makes the chip 2 unduly large. In the latter construction, each driving circuit 13 does require a slightly more complicate construction, but it is not necessary to form the multiple-stage AND circuit in a separate process, and moreover it is possible to prevent the chip 2 from becoming unduly large.

Figure 5:
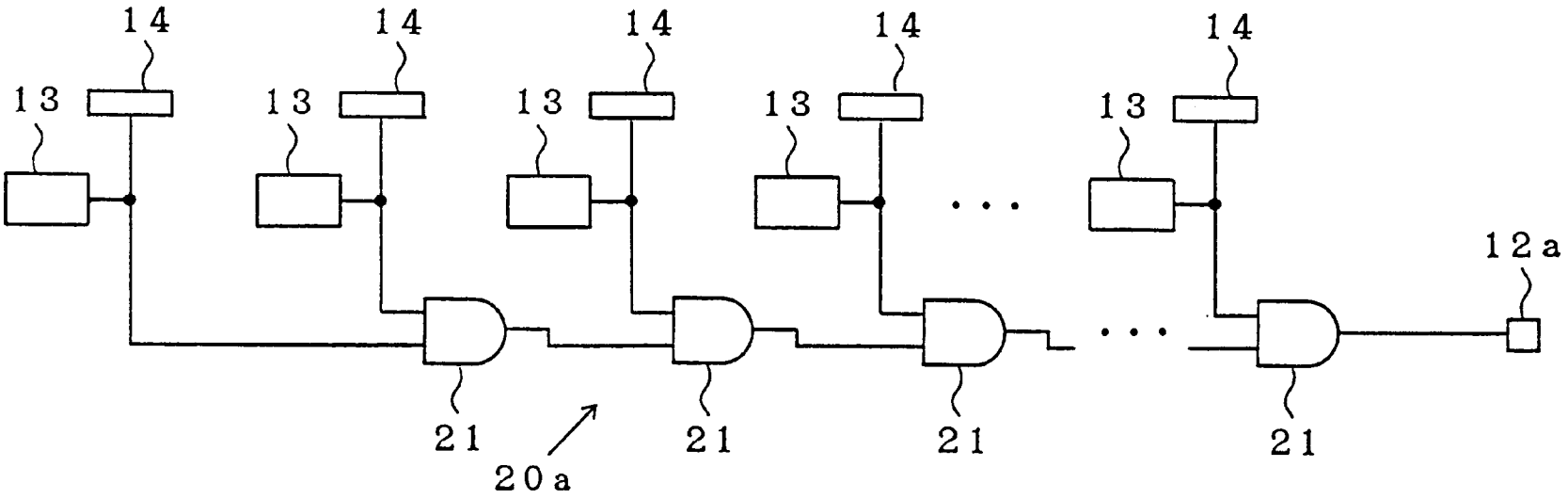
FIG. 5 is a diagram showing another example of the construction of the multiple-stage AND circuit.

FIG. 5 shows a modified example of the multiple-stage AND circuit 20. This multiple-stage AND circuit 20*a* consists of 255 stages, that is, has one less stages than the total number of the driving circuits 13. The first stage receives at its two input terminals the outputs of two driving circuits 13. The stages following the first stage are constructed in the same way as shown in FIG. 4. With this multiple-stage AND circuit 20*a*, too, it is possible, just in the same manner as in the previously-described inspection processes, to check the driving circuits 13 globally as they are in operation and check them individually as they are not in operation.

The fluorescent display tube of a second embodiment of the invention will be described. This fluorescent display tube is different from the fluorescent display tube 1 of the first embodiment only in that it is provided with a multiple-stage OR circuit instead of a multiple-stage AND circuit.

Figure 6:
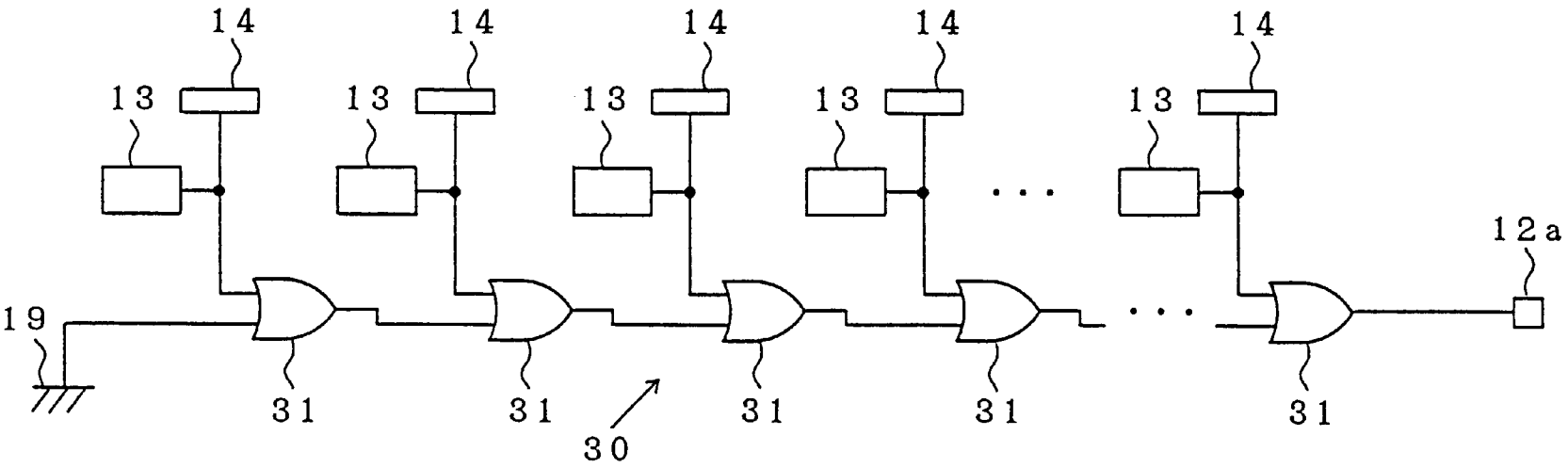
FIG. 6 is a diagram showing the construction of the multiple-stage OR circuit employed in a second embodiment.

FIG. 6 shows the construction of the multiple-stage OR circuit 30. It contains 256 two-input OR circuits 31, and the output terminal of each OR circuit 31 is connected to one input terminal of the next OR circuit 31. One input terminal of the OR circuit 31 at the first stage is connected to a grounded line 19. The other input terminal of each OR circuit 31 is connected to the output of the corresponding driving circuit 13. The output of the OR circuit 31 at the last stage is connected to the inspection terminal 12*a*.

The OR circuit 31 at each stage performs the OR operation on its two inputs, and outputs to the output terminal a voltage equal to the driving voltage output from the driving circuit 13 when the operation result is true and a ground voltage when the operation result is false. The output of the OR circuit 31 at the last stage is equal to the ground voltage only when no driving circuits 13 are outputting the driving voltage, and it is equal to the driving voltage when any one of the driving circuits is outputting the driving voltage.

In this embodiment, the driving circuits 13 are inspected as follows. First, all the driving circuits 13 are fed with a control signal that inhibits output of the driving signal, and the voltage at the inspection terminal 12*a* is measured. If the ground voltage is detected there, it is known that all the driving circuits 13 can properly inhibit output of the driving voltage; if the driving voltage is detected there, it is known that one or more driving circuits are defective circuits that output the driving voltage all the time due to some defect such as a short circuit. Through this inspection, it is possible to check globally whether the driving circuits 13 are functioning properly or not as a whole when they are not in operation.

If no defect has been found in the above non-operation-time inspection, then one of the driving circuits 13 is fed with a control signal that requests output of the control voltage, with all the other driving circuits 13 fed with a control signal that inhibits output of the driving signal, and the voltage at the inspection terminal 12*a* is measured. If the driving voltage is detected there, it is known that the activated driving circuit can properly output the driving voltage; if the ground voltage is detected there, it is known that the activated driving circuit cannot output the driving voltage due to some defect such as an imperfect contact. By applying the control signal that requests output of the driving voltage to one driving circuit after another, it is possible to check individually whether each driving circuit 13 is functioning properly when it is in operation.

In the multiple-stage OR circuit 30 of this embodiment, too, just as in the modified example of the multiple-stage AND circuit 20*a* shown in FIG. 5, it is possible to omit one stage including one OR circuit 31, and instead connect the outputs of two driving circuits 13 to the first stage. Even in that case, the same inspection processes as described above are used.

The fluorescent display tube of a third embodiment of the invention will be described. This fluorescent display tube is provided with both a multiple-stage AND circuit 20 as used in the first embodiment and a multiple-stage OR circuit 30 as used in the second embodiment, and is further provided with an exclusive OR circuit. In other respects, this fluorescent display tube is constructed in the same manner as the fluorescent display tube 1 of the first embodiment, and accordingly overlapping explanations will not be repeated.

Figure 7:
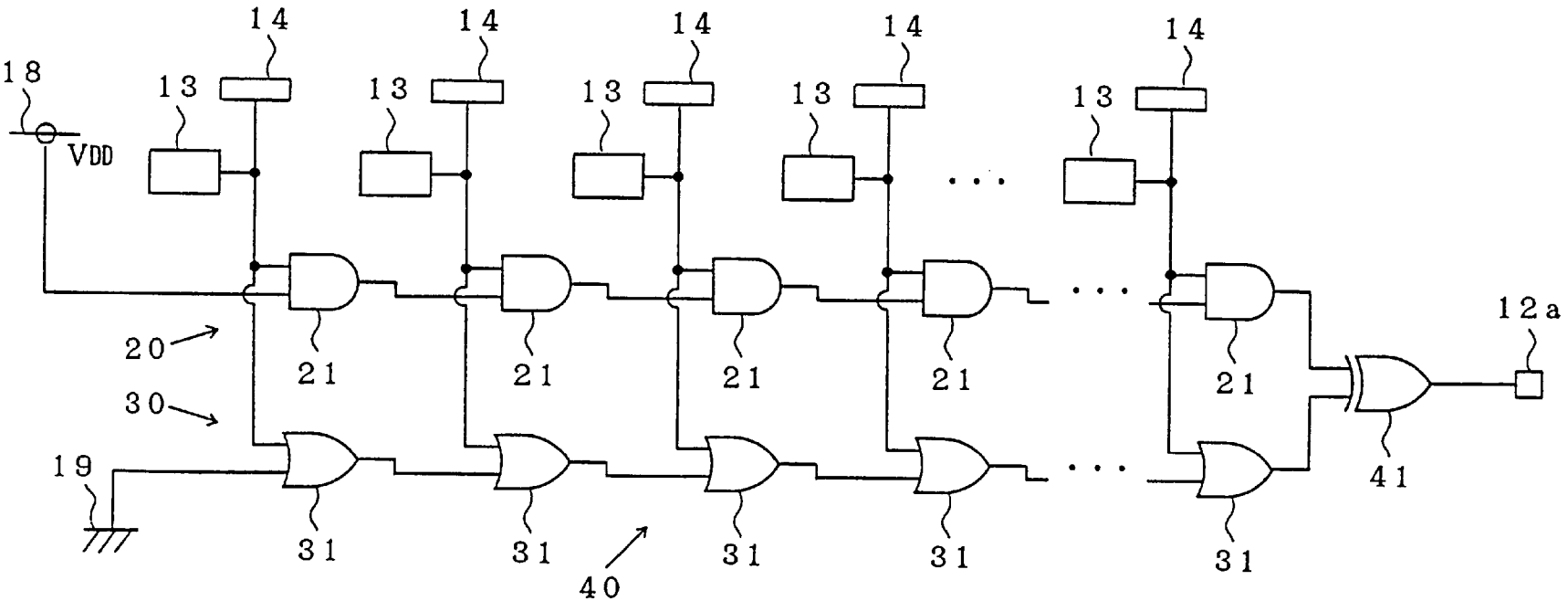
FIG. 7 is a diagram showing the construction of the multiple-stage logic circuit employed in a third embodiment.

FIG. 7 shows the construction of the multiple-stage logic circuit of the third embodiment. In this embodiment, a multiple-stage AND circuit 20 and a multiple-stage OR circuit 30 are arranged in parallel to form a multiple-stage logic circuit 40, and the output of the last-stage AND circuit 21 is connected to one input terminal of an exclusive OR circuit 41, and the output of the last-stage OR circuit 31 is connected to the other input terminal of the exclusive OR circuit 41. The output of the exclusive OR circuit 41 is connected to the inspection terminal 12*a*.

The output of the exclusive OR circuit 41 is equal to the driving voltage when one of the multiple-stage AND and OR circuits 20 and 30 outputs the driving voltage and the other outputs the ground voltage, and it is equal to the ground voltage when both multiple-stage AND and OR circuits 20 and 30 output the driving voltage or the ground voltage. That is, the output of the exclusive OR circuit 41 is equal to the ground voltage only when all the driving circuits 13 are outputting the driving voltage or when all the driving circuits 13 are outputting the ground voltage.

In this embodiment, the driving circuits 13 are inspected as follows. First, all the driving circuits 13 are fed with a control signal that requests output of the driving voltage, and the voltage at the inspection terminal 12*a* is measured. If the ground voltage is detected there, it is known that all the driving circuits 13 can output the driving voltage; if the driving voltage is detected there, it is known that one or more driving circuits are defective circuits that cannot output the driving voltage due to some defect such as an imperfect contact. Through this inspection, it is possible to check globally whether the driving circuits 13 are functioning properly or not as a whole when they are in operation.

Next, all the driving circuits 13 are fed with a control signal that inhibits output of the driving voltage, and the voltage at the inspection terminal 12*a* is measured. If the ground voltage is detected there, it is known that all the driving circuits 13 can inhibit output of the driving voltage; if the driving voltage is detected there, it is known that one or more driving circuits are defective circuits that output the driving voltage all the time due to some defect such as a short circuit. Through this inspection, it is possible to check globally whether the driving circuits 13 are functioning properly or not as a whole when they are not in operation.

Through the above two inspection processes, all the driving circuits 13 are inspected both for defects that appear when they are in operation and for defects that appear when they are not in operation. It should be noted, however, that, if the driving circuits 13 are detective such that all of them either output the driving voltage all the time regardless of the control signal or never output the driving voltage, both of the above two inspection processes end in detecting the ground voltage. However, such a situation is quite rare, and can safely be ignored.

Even if all the driving circuits 13 are defective circuits as described above, it is possible, by applying to one driving circuit a control signal that requests a different action from the signal applied to the other driving circuits, to distinguish the above rare situation from the situation where all the driving circuits are really flawless. Specifically, when one driving circuit is fed with a control signal that requests output of the driving voltage and the other driving circuits are fed with a control signal that inhibits output of the driving signal, the driving voltage appears at the inspection terminal 12*a* if all the driving circuits are functioning properly, and the ground voltage appears at the inspection terminal 12*a* if all the driving circuits are defective. Alternatively, it is also possible to feed one driving circuit with the control signal that inhibits output of the driving signal and feed the other driving circuits with the control signal that requests output of the driving voltage.

Thus, including extremely special cases, it is possible to complete necessary inspection through three inspection processes. It should be noted that, even through these three inspection processes, it is not possible to detect a short circuit between adjacent driving circuits 13. However, it is possible to inspect whether the individual driving circuits are functioning properly or not when they are in operation by applying the control signal that requests output of the driving voltage to one driving circuit after another, and it is also possible to inspect whether the individual driving circuits are functioning properly or not when they are not in operation by applying the control signal that inhibits output of the driving voltage to one driving circuit after another.

In the fluorescent display tubes of the first to third embodiments described above, addition of only one inspection terminal 12*a* makes the inspection of all driving circuits possible, without making the semiconductor chip unduly large as a result of the addition of the inspection terminal. Moreover, since only the voltage at one terminal needs to be measured, the inspection can be finished in a short time.

The multiple-stage logic circuits 20, 30, and 40 can be applied also to, for example, LED display devices. In any display device that has driving circuits one for each of its light-emitting elements, those circuits make it possible to inspect the driving circuits without actually affecting light emission. They are useful not only in a display device, but also in an inspection circuit for inspecting a plurality of electric circuits that each output one of two predetermined levels at a time.

As described heretofore, in the display devices according to the invention, it is possible to check the functioning of the individual driving circuits that are provided to drive the light-emitting elements, not by observing or measuring the light emission of the individual light-emitting elements, but by measuring the output of the logic circuits connected to form a multiple-stage logic circuit. That is, it is possible to inspect the functioning of the driving circuits purely electrically, and thus it is not necessary to rely on the unaided human eye or an optical instrument. Purely electrical inspection demands less expertise and consumes less time. In particular, in a display device that has very small light-emitting units or a large number of light-emitting units, purely electrical inspection requires far less labor and time than inspection that relies on the human eye or an optical instrument.

Moreover, since the inspection can be conducted by use only of the output of the last stage, the display device needs to be additionally provided with only one extra output terminal for inspection, and this can be achieved without making the external construction of the display device unduly complicate. Since all the light-emitting units have an identical construction, only one type of driving circuit and one type of logic circuit need to be designed, and thus it is easy to design and manufacture those circuits. Furthermore, since the driving circuits can be inspected before the display device is finished as a product, the display device can be manufactured efficiently.

The inspection circuits according to the invention permit inspection of the functioning of a plurality of electric circuits at a time. In addition, since the inspection result is represented simply by the output of the last stage of the multiple-stage logic circuit, the inspection circuit requires only one output terminal for inspection, and thus requires only a simple external construction. Moreover, since the constituent logic operation circuits are all common 2-input circuits, the multiple-stage logic circuit has a simple construction and is easy to manufacture.

Obviously, many modifications and variations of the present invention are possible in light of the above teachings. It is therefore to be understood that within the scope of the appended claims, the invention may be practiced other than as specifically described.

What is claimed is:

1. A display device having a plurality of light-emitting units each comprising a light-emitting element and a driving circuit, wherein each light-emitting unit includes a logic circuit that has a first input terminal, a second input terminal, and an output terminal and that performs a logic operation on an input received at the first input terminal and an input received at the second input terminal to output a result of the operation to the output terminal, wherein, in each light-emitting unit, an output terminal of the driving circuit is connected to the first input terminal of the logic circuit, and wherein the output terminal of the logic circuit of one light-emitting unit is connected to the second input terminal of the logic circuit of a next light-emitting unit, so that the logic circuits throughout the display device form a multiple-stage logic circuit as a whole.

2. A display device as claimed in claim 1, wherein the logic circuit of each light-emitting unit is an AND circuit.

3. A display device as claimed in claim 1, wherein the logic circuit of each light-emitting unit is an OR circuit.

4. A display device as claimed in claim 1, wherein the logic circuits throughout the display device are divided into two groups each forming a separate multiple-stage logic circuit as a whole, one group including only AND circuits and having an output terminal of the last-stage AND circuit connected to an input terminal of an exclusive OR circuit, the other group including only OR circuits and having an output terminal of the last-stage OR circuit connected to another input terminal of the exclusive OR circuit.

5. A display device as claimed in claim 1, wherein the display device is formed as a fluorescent display tube by forming each light-emitting element as a spot of fluorescent material and housing the plurality of light-emitting units in a vacuum tube.

6. An inspection circuit for inspecting a plurality of electric circuits that each output a first voltage when in operation and output a second voltage lower than the first voltage when not in operation, comprising:

a plurality of logic circuits all performing a same logic operation and each having a first input terminal, a second input terminal and an output terminal and outputting either the first voltage or the second voltage in accordance with a result of the logic operation, wherein the output terminal of one logic circuit is connected to the second input terminal of a next logic circuit, so that the logic circuits form a multiple-stage logic circuit as a whole, and wherein each of the logic circuits receives, at its first input terminal, a voltage output from one of the plurality of electric circuits, and the logic circuit of a first stage of the multiple-stage logic circuit receives, at its second input terminal, the first voltage or the second voltage, so that a voltage output from the logic circuit of a last stage of the multiple-stage logic circuit indicates whether the plurality of electric circuits are functioning properly or not.

7. An inspection circuit as claimed in claim 5, wherein the logic circuits are AND circuits, and the first voltage is fed to the second input terminal of the logic circuit of the first stage so that the voltage that is output from the logic circuit of the last stage when all electric circuits are in operation indicates globally whether the electric circuits are functioning properly or not as a whole when they are in operation, and that the voltage that is output from the logic circuit of the last stage when only one electric circuit is not in operation indicates individually whether that one electric circuit is functioning properly or not when it is not in operation.

8. An inspection circuit as claimed in claim 6, wherein the logic circuits are OR circuits, and the second voltage is fed to the second input terminal of the logic circuit of the first stage so that the voltage that is output from the logic circuit of the last stage when no electric circuits are in operation indicates globally whether the electric circuits are functioning properly or not as a whole when they are not in operation, and that the voltage that is output from the logic circuit of the last stage when only one electric circuit is in operation indicates individually whether that one electric circuit is functioning properly or not when it is in operation.

* * * * *